US008316779B2

(12) United States Patent
Gordon

(10) Patent No.: US 8,316,779 B2
(45) Date of Patent: Nov. 27, 2012

(54) COLLAPSIBLE PALLET SYSTEM AND METHODS

(76) Inventor: Norman H. Gordon, Munster, IN (US)

( * ) Notice: Subject to any disclaimer, the term of this patent is extended or adjusted under 35 U.S.C. 154(b) by 580 days.

(21) Appl. No.: 12/459,878

(22) Filed: Jul. 9, 2009

(65) Prior Publication Data

US 2010/0012000 A1 Jan. 21, 2010

Related U.S. Application Data

(63) Continuation-in-part of application No. 11/118,904, filed on Apr. 29, 2005, now Pat. No. 7,913,629.

(60) Provisional application No. 60/566,256, filed on Apr. 29, 2004, provisional application No. 60/632,554, filed on Dec. 1, 2004, provisional application No. 60/652,871, filed on Feb. 15, 2005.

(51) Int. Cl.
*B65D 19/00* (2006.01)

(52) U.S. Cl. ..... 108/51.3; 108/51.11

(58) Field of Classification Search ..... 108/51.3, 108/51.11, 56.1, 57.29, 54.1; 206/386, 600, 206/736, 756, 774; 211/195, 72, 73; 312/258
See application file for complete search history.

(56) References Cited

U.S. PATENT DOCUMENTS

| | | | | | |
|---|---|---|---|---|---|
| 1,471,974 | A | * | 10/1923 | Mix | 312/45 |
| 2,003,244 | A | * | 5/1935 | Carboni | 211/88.01 |
| 2,020,834 | A | * | 11/1935 | Hatten | 220/6 |
| 2,104,523 | A | * | 1/1938 | Leo | 221/197 |
| 2,444,183 | A | | 6/1948 | Cahners | |
| 2,494,730 | A | | 1/1950 | Thursby | |
| 2,611,569 | A | | 9/1952 | Coleman et al. | |
| 2,643,080 | A | | 6/1953 | Vogel | |
| 2,904,297 | A | | 9/1959 | Hamilton | |
| 3,041,029 | A | | 6/1962 | Brown | |
| 3,167,038 | A | | 1/1965 | Brown | |
| 3,216,376 | A | | 11/1965 | Anderson et al. | |
| 3,246,824 | A | | 4/1966 | Gardner | |
| 3,308,772 | A | | 3/1967 | Thomas | |
| 3,434,435 | A | | 3/1969 | Achermann et al. | |
| 3,514,030 | A | * | 5/1970 | Carroll | 206/599 |
| 3,602,158 | A | | 8/1971 | Skaggs | |
| 3,626,860 | A | | 12/1971 | Blatt | |
| 3,659,707 | A | * | 5/1972 | Nilsson et al. | 206/597 |
| 4,090,659 | A | * | 5/1978 | Galmiche et al. | 229/103.11 |
| 4,091,923 | A | | 5/1978 | Collins | |
| 4,095,769 | A | | 6/1978 | Fengels | |
| 4,185,565 | A | | 1/1980 | Nymoen | |
| 4,303,020 | A | | 12/1981 | Houle | |
| 4,378,743 | A | | 4/1983 | McFarland | |
| 4,694,962 | A | | 9/1987 | Taub | |

(Continued)

FOREIGN PATENT DOCUMENTS

FR 2713201 * 6/1995

(Continued)

*Primary Examiner* — Janet M Wilkens
(74) *Attorney, Agent, or Firm* — Valauskas Corder LLC

(57) ABSTRACT

Formable pallets that are easy to construct into a generally stably product receiving state and easy to collapse into a storage/transport state. The pallet includes one or more display elements which may be integrated with the supporting platform to achieve point of purchase objectives. The display element may be a separate component that is removeable from the pallet or the display element may be configurable from the pallet such as by unfolding and/or folding portions of the supporting platform.

5 Claims, 6 Drawing Sheets

U.S. PATENT DOCUMENTS

| | | | | | |
|---|---|---|---|---|---|
| 4,759,295 | A | | 7/1988 | Nilsen et al. | |
| 4,831,938 | A | | 5/1989 | Atterby et al. | |
| 4,863,024 | A | | 9/1989 | Booth | |
| 4,864,940 | A | | 9/1989 | Dunn | |
| 5,020,674 | A | * | 6/1991 | Thorud et al. | 206/600 |
| 5,141,109 | A | | 8/1992 | Bergeron, Sr. | |
| 5,230,291 | A | | 7/1993 | Juvik-Woods | |
| 5,285,731 | A | | 2/1994 | McIntyre | |
| 5,365,857 | A | | 11/1994 | Kilpatrick et al. | |
| 5,377,600 | A | * | 1/1995 | Speese et al. | 108/51.3 |
| 5,503,085 | A | | 4/1996 | Rozek | |
| 5,562,048 | A | | 10/1996 | Gottlieb | |
| 5,662,048 | A | | 9/1997 | Kralj et al. | |
| 5,706,953 | A | * | 1/1998 | Polvere | 206/736 |
| 5,809,903 | A | | 9/1998 | Young, Jr. | |
| 5,921,187 | A | | 7/1999 | Wang | |
| 5,996,510 | A | | 12/1999 | Harpman et al. | |
| 6,041,719 | A | | 3/2000 | Vidal et al. | |
| 6,079,560 | A | * | 6/2000 | Champion | 206/386 |
| 6,196,383 | B1 | | 3/2001 | Pinchen et al. | |
| 6,267,258 | B1 | * | 7/2001 | Wilkerson et al. | 211/151 |
| 6,357,364 | B1 | | 3/2002 | Maloney et al. | |
| 6,516,730 | B1 | * | 2/2003 | Mason | 108/55.1 |
| 6,564,724 | B2 | | 5/2003 | Moberg | |
| 6,600,418 | B2 | | 7/2003 | Francis et al. | |
| 6,669,089 | B2 | | 12/2003 | Cybulski et al. | |
| 6,809,703 | B2 | | 10/2004 | Serra | |
| 7,231,879 | B2 | | 6/2007 | Gordon | |
| 2001/0025589 | A1 | | 10/2001 | Moberg | |
| 2003/0209171 | A1 | | 11/2003 | Milles | |
| 2004/0217250 | A1 | | 11/2004 | Kido et al. | |
| 2004/0217867 | A1 | | 11/2004 | Bridgelall | |
| 2004/0221771 | A1 | | 11/2004 | Moore, Jr. et al. | |
| 2004/0222127 | A1 | | 11/2004 | McLeod et al. | |
| 2004/0222542 | A1 | | 11/2004 | Jan et al. | |
| 2004/0226157 | A1 | | 11/2004 | Isle et al. | |
| 2004/0226416 | A1 | | 11/2004 | Lane et al. | |
| 2004/0226488 | A1 | | 11/2004 | Zakaria et al. | |
| 2004/0226489 | A1 | | 11/2004 | Greene | |
| 2004/0233040 | A1 | | 11/2004 | Lane et al. | |
| 2004/0237418 | A1 | | 12/2004 | MacBeth MacWatt | |
| 2004/0237419 | A1 | | 12/2004 | MacWatt | |
| 2004/0237850 | A1 | | 12/2004 | Horiuchi | |
| 2004/0238634 | A1 | | 12/2004 | Chang et al. | |
| 2004/0249661 | A1 | | 12/2004 | Wu | |
| 2004/0254759 | A1 | | 12/2004 | Kubach et al. | |
| 2004/0260587 | A1 | | 12/2004 | Vanduyne | |
| 2005/0006990 | A1 | * | 1/2005 | Williquette et al. | 312/61 |
| 2005/0023168 | A1 | * | 2/2005 | Marnocha | 206/386 |
| 2007/0158224 | A1 | * | 7/2007 | Bringard et al. | 206/386 |
| 2007/0170085 | A1 | * | 7/2007 | Hoogland | 206/600 |
| 2009/0071381 | A1 | * | 3/2009 | Ponto | 108/55.5 |
| 2011/0048990 | A1 | * | 3/2011 | Goda | 206/386 |

FOREIGN PATENT DOCUMENTS

| | | | |
|---|---|---|---|
| FR | 2768406 | * | 3/1999 |
| JP | 06239345 | | 8/1994 |
| JP | 06239346 | | 8/1994 |
| JP | 2001322625 | * | 11/2001 |
| JP | 2006199328 | * | 8/2006 |

* cited by examiner

COLLAPSIBLE PALLET SYSTEM AND METHODS

This application is a continuation-in-part of U.S. patent application Ser. No. 11/118,904, filed Apr. 29, 2005 now U.S. Pat. No. 7,913,629, which claims the benefit of U.S. Provisional Application No. 60/566,256 filed Apr. 29, 2004, U.S. Provisional Application No. 60/632,554 filed Dec. 1, 2004, and U.S. Provisional Application No. 60/652,871 filed Feb. 15, 2005.

FIELD OF THE INVENTION

The present invention relates to a collapsible pallet and more specifically to a pallet formed from a sheet material. The collapsible pallet includes one or more display elements which is displayable from an inside surface of a supporting platform of the pallet to achieve point of purchase objectives.

BACKGROUND OF THE INVENTION

Pallets are platforms for supporting weight thereon, and by which materials, packages, or goods that are stacked thereon may be handled, stored and/or moved. Goods positioned on pallets are typically moved and stored in warehouses, factories, or vehicles, for example, by forklift equipment, in which the forklift tines are inserted into channels in the pallet or by way of engagement with an undersurface of a top deck of the pallet.

Pallets have traditionally been formed from wood, plastic and various composite materials. Wood pallets, however, are subject to breakage and difficult to obtain and maintain in a sanitary condition. In environments where sanitation is important, such as in the food industry, pallets may be of limited usefulness. From time to time, the wood used in pallets is also known to contain eggs or actual insects thereby causing problematic infestations. Plastic pallets are bulky and initially, may be very expensive. Wood or plastic pallets are typically provided in a fully erected or constructed state and not deconstructed when not in use and therefore always require a maximum amount of space.

Materials, packages, or goods that are placed on pallets for transport are typically stored thereon and eventually moved off the pallet, for example, to exhibit for sale. For example, goods are moved from the pallet to a point of purchase display in a retail space. A point of purchase display includes cases, shelves, containers, cells, bins, tubes and towers to name a few.

While a number of attempts have been made to design inexpensive, but structural dependable pallets, there continues to be a need for improvements in both cost, ease of use, and overall strength. Additionally, there continues to be a need for improvements in functionality and versatility of pallets, for example, pallets that can be configurable to form displays to achieve point of purchase objectives. The present invention satisfies this need.

SUMMARY OF THE INVENTION

The present invention is directed to a pallet that is easily assembled by a single person without tools and from easily transported and manipulated components. The components can be varied to easily provide pallets of different size and structural dependability. Each of the components for and the assembled pallet is lightweight and uses fewer materials than many pallets made from similar materials. This further reduces waste, lowers shipping costs and ultimately fuel consumption costs associated with the transport of the product shipped on the pallets on the issue of fuel consumption. It has been estimated by the Ford Motor and Automotive Aluminum Association that for every 10 percent reduction in vehicle weight there is a corresponding 6 to 8 percent savings decrease in fuel usage. Comparing an embodiment of the pallet of the present invention to a standard 48×40 inch wood pallet, a savings in fuel usage to carry up to 1200 pounds per truck load (i.e., 30 pounds per pallet savings multiplied by 40 pallets per truck) would result. Less weight means decreased fuel usage and therefore fewer atmospheric emissions. Also, since weight is a factor in road and highway damage, the less weight per truck means less road damage and fewer traffic jams due to highway construction.

The modular pallet of the present invention is formed from one or more components that can be shipped and stored in a largely flattened state. As a result, prior to assembly, a pallet according to the present invention can take up little space, thereby reducing transportation and storage costs. After formation or assembly, for example, the pallet may be racked into the size permitted by the components, such as a space occupying 4-½"×48"×42".

The materials from which the pallet components may be made can be "environmentally friendly," and therefore present low environmental impact. The pallet of the present invention and its components may be formed or joined without the use of metal staples, nails, or other fasteners. The staples, nails or other fasteners used in constructing conventional pallets are typically environmentally "less friendly". They also may cause harm, such as to a user, when dislodged from the pallet. The use of materials other than wood for the collapsible pallet of the present invention is also economically and environmentally friendly. For example, the use of material other than wood for one or more components of the pallet of the present invention mostly eliminates the need to fumigate the pallet in order to destroy those destructive elements, such as the longhorn beetle that can typically harbor in the wood. In addition, the collapsible pallet of the present invention can be re-used multiple times. Due to the materials used in preferred embodiments of the invention, namely cardboard and like paper-based materials, repairs can be easily made and the present invention contemplates the use of what are termed "repair kits" with the pallets.

The materials from which the components of the pallet may be made may be of a composition, or treated with other materials so that the components and the assembled pallet is generally insect or germ free and water resistant thereby permitting the pallet to be used in a moist or wet environment without perceptible loss in structural dependability. Other embodiments may include components and be structured so that the pallets are fire resistant, heat resistant, anti-static, or respond to additional user transport and storage specifications.

In terms of construction, pallets of the present invention can be easily assembled by hand, but are more efficiently assembled by machine in an automated process. It will be understood that automated assembly of the pallet saves time and reduces cost while providing control of quality. Automated assembly offers various options during the assembly of the pallet—for example, the addition of waterproofing chemicals, paint, water resistant or anti-static chemicals applied to the pallet during assembly all of which are contemplated by the present invention. For example, a waterproofed or water resistant pallet is ideal for storing goods off the floor in the event of moisture or flooding. Automated assembly may also seal the ends of the tubes, eliminating the need for end-caps or other closure type mechanisms to provide an aesthetic appeal by eliminating the exposure of the internal structure of the pallet. Automated assembly may further include the attachment of tracking devices, e.g., tags or labels, and including RFID devices, or hologram or other images, to convey tracking or identification information and other indicia or information as is known in the art. Tracking information includes shipment and delivery information, for example, where the pallet with goods is located from the shipment location to the delivery location. Identification information includes the details about the load being transported or carried on the pallet, for example the product and manufacturer. Instructional information or directions explaining the functionality of spacing items or manipulation of the pallets into various functional structures can also be integrated with the pallet during machine assembly. It is further contemplated that the machine assembly may include in-line printing and die cutting options.

The pallet of the present invention includes tubing elements, either singular or multi positional, for the construction of a generally stable platform, either in a permanent or semi-permanent way. The tubing may be sized and shaped to hold a variety of materials on the inside or outside thereof, yet not restrict the ability of the pallet to be assembled or disassembled in a "knock-down" fashion and provide a variety of options for reinforcing the strength and stability of the pallet by adding or subtracting material structure and material strength depending on the load placed on the platform. Heavier loads may require higher yield material while lighter loads may be constructed of lesser yield materials.

Additional advantageous features of the pallet of the present invention are many. The pallet may include informational surfaces that may be used, if desired, for informational purposes such as by being decorated by processes of printing, laminating, stamping, spraying, etc. and can offer benefits such as bar coding, assembly instructions, and advertising. The platform may carry radio frequency friendly identification devices by which information concerning, for example, ownership and use and location of the platform may be provided. Various parts, sections or components of the pallet may be color coded, for example, for decorative purposes or for informational purposes such as to identify the carrying capacity or special use purpose of the pallet, to identify the owner of the material carried on the pallet, the owner of the pallet, promotional or advertising purposes, or simply to facilitate the construction or deconstruction of the pallet.

Additionally, the material used, in the making of the platform, may also be constructed in such a way that it offers cushioning to help absorb shock vibrations. The platform user may be able to choose if they wish the platform delivered to them in an assembled state for immediate use or in a disassembled state for each pallet assembly. Because the components of the platform are sized and shaped to fit in a reduced amount of space (relative to the fully assembled pallet) in a disassembled state, shipping and storage costs are reduced. The platform may be made so that it can be erected by hand, hand and machine or machine only. This offers a number of options in the assembly process. The platform, if need be, can be constructed in such ways that it can be moved on conveyors or accept wheels, castors, or another roller type product for movement, or racking systems for storage or display. Multiple points of entry can be provided in pallets of the present invention so that, for example, a fork lift truck or hand jack or other mechanical assistance can be used to lift and move the pallet. Components of the pallet can be formed through materials that facilitate reuse or recycling of the components or the material from which the components are made. The platform can be constructed so that additional elements, such as add-on parts, can be added to give the platform added benefits such as display advertising, void filling, and convention type presentation. The platform itself may be saved and recycled to use as a cost saving feature in other inventions.

A further object of the present invention is to provide a pallet some embodiments of which include decorative or esthetic elements such that the pallet may be used in more public venues and not simply the warehouse. Conventional pallets, to the extent they are constructed of cardboard, have corrugated flutes. Embodiments of the present invention eliminate what may be viewed as aesthetically unappealing exposure of corrugated flutes by providing various assembly constructions such that the cross sections of the corrugated cardboard are hidden or secluded from all outside or exposed surfaces. Moreover, it is contemplated the present invention may be assembled of cardboard constructed without corrugated flutes. The singularity of sheet through a printing press means the sheet can be printed and die cut at the same time thereby saving money on many decorative operations.

A further object is to provide a tracking functionality to one or more pallet embodiments, for example, through the single or coordinated use of bar codes, hologram, or RFID tags (tracking devices). A bar code is a series of lines of that can be read by a computer input device, for example, a bar code scanner and provide a wide variety of information. A hologram is a three-dimensional photograph or illustration, created with an optical process that uses lasers. Holograms are difficult to replicate or counterfeit. A RFID tag, or radio frequency identification tag, is a type of electronic identification that uses radio frequency signals to read information. A tracking device may be applied to each component, larger groupings of components, or the fully assembled pallet. The tracking device can communicate a variety of information, for example, certification of the maximum weight the pallet is capable of supporting, origin, and destination of the product associated with a particular pallet along with the location at any given moment in time. It is further contemplated that the tracking device may include other sorts of information such as a customer's logo. The components of the pallet may additionally have designations by which the pallet components may be identified, located, and tracked. Components suitable for reuse may include designations or identifications that assist one or more subsequent purchasers of the use history of that component. A corporate certification stamp such as one backed by insurance, that, for example, is used in the corrugated box industry, can be used to designate manufacturing guarantees such as product transport or storage warranties. One or more components of the pallet may be certified, such as in printed information including the manufacturer's or shipper's information, identification or logo to make sure that only that business' product is shipped or used with the identified pallet. This is important when quality control certification only applies when the business' given product is carried on the identified pallet. Other features will become apparent in the following description.

While the prior art describes many variations on cardboard type pallets and related products, no apparatus system or method is described wherein a pallet is formed with support beams that are integrally formed from the sheet material base. Embodiments of the present invention can include supporting inserts in the beams as well as cross-braces or slats located against the underside of the base platform itself. The beams as well as the platform are structurally supported by cross-braces, which run at right angles to the beams. They can be angled, positioned, or arranged in different formats depending on the need.

In other words, embodiments of the pallet of the present invention include beams, which are supported internally by structural inserts that may be of varying size and shape. Moreover, the inserts may further include braces that are positioned within the structural inserts to provide additional support. The braces may be of any suitable material, size, and shape to fit within the structural insert.

Embodiments may include cross-braces that pass through an aperture in the beams themselves. The cross-braces may be positioned such that they do not interfere with the structural inserts or braces. Moreover, the structural inserts and braces themselves may include slots through which the cross-braces may pass. The cross-braces may pass underneath and support the underside of the platform to create significant structural support.

A further object of the present invention is to provide embodiments having a supporting structure, or stabilizer, under the pallet to adequately distribute the load carried on the platform panel of the pallet. The stabilizer can be of any shape or size and constructed from various materials including, wood, plastic, cardboard, fiberboard, rigid foam, fiberglass, carbon-fiber, composite materials and so on, capable of providing support to the platform panel of the pallet.

Multiple pallets may be joined, such as through a variety of simplified embodiments of the pallet including those having interconnecting male and female components that permit the engagement of the male protrusion into a female receptacle, each of which is positioned within the support beams. The male protrusion and female receptacle can be broken down flat along with the entirety of the pallet for ease of shipping and storage described above.

The present invention, in one aspect, is a pallet fabricated of a sheet of material for receiving product, including a platform including a first platform side and a second platform side, the first platform side being opposite the second platform side. In one embodiment, the pallet may include a beam that is sized, shaped and positioned to assist in the support of a load on the generally horizontal product support surface of the pallet.

In another embodiment, the pallet may include a plurality of support beams to assist in the support of loads on the product support surface of the pallet. For example, one such embodiment that may include a first beam located along the first platform side on an underside of the platform and a second beam located along the second platform side on the underside of the platform to assist in the support of a load on the support surface of the pallet.

Embodiments of the pallet may include one or more support beams sized and shaped and constructed to accommodate the receipt of an insert. For example, an insert may be positioned in one or more of the support beams, each of the inserts being constructed and formed of a material capable of assisting in the support of at least the weight of the product carried on the product support surface thereon.

Another aspect of the invention provides a pallet for receiving product thereupon, including a platform including a first platform side and a second platform side, the first platform side being opposite the second platform side. A first beam is located along the first platform side on an underside of the platform and a second beam is located along the second platform side on the underside of the platform. A third beam is positioned between the first beam and the second beam and an insert is positioned in each of the first beam, second beam and third beam, each insert being constructed and formed of a material capable of withstanding at least the weight of the product bearing thereupon.

Yet another aspect of the invention provides a pallet for receiving product, including a platform with a first platform side and a second platform side, the first platform side being opposite the second platform side. A first beam is positioned along the first platform side on an underside of the platform. A second beam is positioned along the second platform side on the underside of the platform. A third beam is positioned between the first beam and the second beam. Each of the first beam, the second beam and the third beam may include a plurality of cross-brace beam openings formed therethrough. Accordingly, a plurality of cross-braces may be positioned in the cross-brace beam openings to extend from the first platform side to the second platform side and adjacent the underside of the platform to support the platform. An insert is positioned in each of the first beam, second beam and third beam, each insert being constructed and formed of a material capable of withstanding at least weight of the product bearing thereupon.

Yet another aspect of the invention provides a pallet for receiving product, including a platform with a first platform side and a second platform side, the first platform side being opposite the second platform side. A first beam is positioned along the first platform side on an underside of the platform. A second beam positioned along the second platform side on the underside of the platform. A support structure is positioned between the first beam and the second beam, wherein each of the beams includes a plurality of cross-brace beam openings formed therethrough. Cross-braces are positioned in the cross-brace beam openings to extend from the first platform side to the second platform side and adjacent the underside of the platform to support the platform. Inserts in each of the first beam, second beam and third beam, are constructed and formed of a material capable of withstanding at least weight of the product bearing thereupon.

Yet another embodiment of the invention provides a pallet for receiving product, including a platform with a first platform side and a second platform side, the first platform side being opposite the second platform side. A first beam is positioned along the first platform side on an underside of the platform. A second beam is positioned along the second platform side on the underside of the platform. Each of the first beam and the second beam includes a plurality of cross-brace beam openings formed therethrough. Cross-braces are positioned in the cross-brace beam openings to extend from the first platform side to the second platform side and adjacent the underside of the platform to support the platform and an insert is positioned in each of the first beam, second beam and third beam. Each insert is constructed and formed of a material capable of withstanding at least weight of the product bearing thereupon.

Yet another embodiment of the invention provides a pallet system for receiving product, including a pallet with a platform including a first platform side and a second platform side, the first platform side being opposite the second platform side. A first beam is located along the first platform side on an underside of the platform. A second beam is located along the second platform side on the underside of the platform. An insert is positioned in each of the first beam and second beam. Each insert is constructed and formed of a material capable of withstanding at least weight of the product bearing thereupon. A hollow, rectangular sleeve is sized and shaped to fit over the pallet.

Yet another embodiment of the invention provides a system for supporting, transporting and/or storing product, including a first pallet with a first pallet platform including a first platform side and a second platform side, the first platform side being opposite the second platform side. A first beam is located along the first platform side on an underside of the platform. A second beam is located along the second platform side on the underside of the platform, wherein the second beam includes one or more male protrusions. A second pallet is provided with a second pallet platform including a third platform side and a fourth platform side, the third platform side being opposite the fourth platform side. A third beam is located along the third platform side on an underside of the second pallet platform. A fourth beam is located along the fourth platform side on the underside of the second pallet platform, wherein the fourth beam includes one or more female receptacles sized and shaped to receive the one or more male protrusions to form a combined pallet system from the first pallet and the second pallet. An insert is provided in each of respective the first beam, the second beam, the third beam and the fourth beam, each insert being constructed and formed of a material capable of withstanding at least weight of the product bearing thereupon.

Yet another embodiment of the invention provides a system for supporting, transporting and/or storing product, including a pallet with a platform including a first platform side and a second platform side, the first platform side being opposite the second platform side. A first beam is located along the first platform side on an underside of the platform. A second beam is located along the second platform side on the underside of the platform. An insert is positioned in each of the first beam and second beam, each the insert being constructed and formed of a material capable of withstanding at least weight of the product bearing thereupon.

Another aspect of the invention provides a method of forming a pallet, including providing a sheet of material, positioning one or more cross-braces on an underside of the sheet of material, positioning two or more spaced inserts on the underside of the sheet of material and over the one or more cross-braces, and assembling a beam over each of the two or more spaced inserts, whereby both the one or more cross-braces and the two or more spaced inserts are locked in place with each of the two or more spaced inserts being located within a respective beam.

Yet another aspect of the invention provides a lightweight, foldable cost-saving pallet system for shipping product, including a pallet with a single sheet of foldable material including a central platform with a first platform side and a second platform side, the first platform side being opposite the second platform side. A first beam is located along the first platform side on an underside of the central platform. The first beam is shaped to expand from a first configuration to a second configuration, wherein the first configuration is rhomboid or a flattened rectangle in cross section and the second configuration is in the form of a hollow rectangle in cross section. A second beam is located along the second platform side on the underside of the central platform, wherein the second beam has the same shape as the first beam. An insert is sized and shaped to fit within each of the first beam and the second beam when the first beam and the beam are in the second configuration, each insert being constructed and formed of a material capable of withstanding at least weight of the product bearing thereupon.

Yet another aspect of the invention provides a system for supporting product with a tracking feature, including a pallet for supporting product thereupon, including a platform including a first platform side and a second platform side, the first platform side being opposite the second platform side. A first beam is located along the first platform side on an underside of the platform. A second beam is located along the second platform side on the underside of the platform. An insert is positioned in each of the first beam and second beam, each insert being constructed and formed of a material capable of withstanding at least weight of the product bearing thereupon and a tracking device for tracking one or both of the pallet and product positioned upon the pallet. The tracking device may be a RFID or the like encapsulated in the pallet material or inside a separate compartment of the pallet.

Aspects of the present invention are provided to add or increase a number of capabilities of a pallet in addition to reducing cost, weight, and environmental impact and so on. It will be recognized, based on the present application, that a pallet is not only a portable platform used for storing, packing, or moving cargo or freight, for example, but also a portable structure that can space items or be manipulated into various other functional structures such as displays.

Yet another embodiment of the invention provides a display element to achieve a point of purchase objective such as to exhibit the materials, packages, or goods supported by the pallet. No apparatus system or method of the prior art is described wherein a pallet is configurable to a display for goods. The display element may be erected once the pallet reaches its final display destination. The display element may be erected automatically or manually into position. The display element is shipped and stored in a largely flattened state.

While the display element may be formed from a generally continuous, single material sheet sized and shaped and constructed so that a display may be formable therefrom such as a paper-based, non-paper based or composite material, one preferred material from which the display element may be made is corrugated paperboard or cardboard. Other suitable materials include a single type of plastic or combinations of types of plastic or plastic/paper combinations of material, or other composite materials. Also, other suitable materials include wood, fiberglass, laminated materials, metal, or extruded recycled materials, for example.

The display element may be confined by confinement elements—including plastic wrapping—and erected by tearing a perforation sealing of the display element such that the display element automatically erects into position. It is further contemplated the display element can be manually erected. The display element can be used as a point-of-purchase display that communicates display information, such as advertising and so on, about product or articles carried on the pallet. The display element may function as a structural part of the pallet and disconnected therefrom to form a display or as an additional panel or panels of material which are disconnected from the pallet before use as a display. Configurations of displays are well known in the art, for example, the display element may form one or more selected from the group of cases, shelves, containers, cells, bins, tubes and towers. The display element may cover some or the entire pallet.

The display element may be integrated with the pallet, more specifically the supporting platform. The display element is positioned substantially about the inside surface of the supporting platform during transport and is easily accessible to form a display at any desired time.

The display element is displayable from an inside surface of the platform of the pallet. The display element may be a separate component that is stored and removeable from the inside surface of the platform of the pallet or configurable from the platform of the pallet. The display element may be configurable from one or more components and may further be erected to form a display of any size and/or configuration.

More specifically, the platform includes an inside surface and an outside surface and a hinge element or flexible joint element that connects the platform to a support element. For purposes of this application, a support element comprises one or more of the following: beams, pallet sections, supporting inserts, cross-braces, planar sections, and slats. A display element is displayable from at least the inside surface of the platform. Exposure of the inside surface of the platform is achieved by moving the platform via the hinge element. The display element may be erected separate from the pallet, on the outside surface of the platform of the pallet, or on the inside surface of the platform of the pallet when the platform is any contemplated position according to movement of the hinge element. It is also contemplated that the display element may be erected on the support element, for example, on the beams and planar sections.

In embodiments where the display element is a separate component removeable from the inside surface of the platform, the display element is removed and erected to form a display upon exposing the inside surface of the platform. The display element may be erected by folding and/or unfolding portions such as by using one or more score line elements, otherwise referred to herein as fold line elements. The display element may further be fastened together and/or to the pallet with any type of fastening component such as Velcro®, adhesive, magnets, tape, tension fit, interference fit, or the like.

In embodiments where the display element is configurable from the platform of the pallet, the display element is erected such as by unfolding and/or folding portions of the platform such as by using one or more score line elements. Portions of the display element may further be fastened together and/or to the pallet with any type of fastening component as described above.

The display element may further include display information. Display information includes advertising, trademarks, text, graphics, pictures, logos, etc.

The present invention and its attributes and advantages further understood, will be further appreciated with reference to the detailed description below of some presently contemplated embodiments, taken in conjunction with the accompanying drawings.

BRIEF DESCRIPTION OF THE DRAWINGS

The preferred embodiments of the invention will be described in conjunction with the appended drawings provided to illustrate and not to the limit the invention, where like designations denoted like elements, and in which.

DETAILED DESCRIPTION OF THE PREFERRED EMBODIMENTS

This application incorporates by reference the entire subject matter of U.S. patent application Ser. No. 11/118,904, filed Apr. 29, 2005 and U.S. Pat. No. 7,231,879, filed Aug. 31, 2005.

The present invention will now be described in detail with reference to preferred embodiments as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures are not described in detail in order to not unnecessarily obscure the present invention. For convenience of description, terms such as "upper", "lower", "top", "bottom", "above", "underneath", "outer", "inner", "horizontal", "vertical" "outwardly", and "inwardly" are used to refer to the orientation illustrated in the accompanying drawings. However, it will be understood that embodiments advantageously can be used in a variety of orientations.

According to the present invention, one embodiment of a pallet including display element is of a unique construction including a continuous, single material sheet. Another embodiment is a pallet including display element each of which is of a unique construction including each made from a continuous, single material sheet. Preferably, the material from which the sheet is made is corrugated paperboard or cardboard. However, any suitable material may be used, such as, for example, plastic or combinations of plastic and paper material or other composite materials. Also, the material may include wood, metal, or extruded recycled material. The present invention may relate to an assemblable pallet including display element and more specifically assembled from a sheet-like material.

The present invention includes the ability to provide one or more display elements in a flat condition, which when needed, is easily erected into a display.

A key feature of the present invention is to provide one or more display elements which may be integrated with the supporting platform to achieve point of purchase objectives. The display element is transported with the pallet and may be a separate component that is removeable from the pallet or may be configurable from the pallet such as by unfolding and/or folding portions of the supporting platform.

Figure 1:
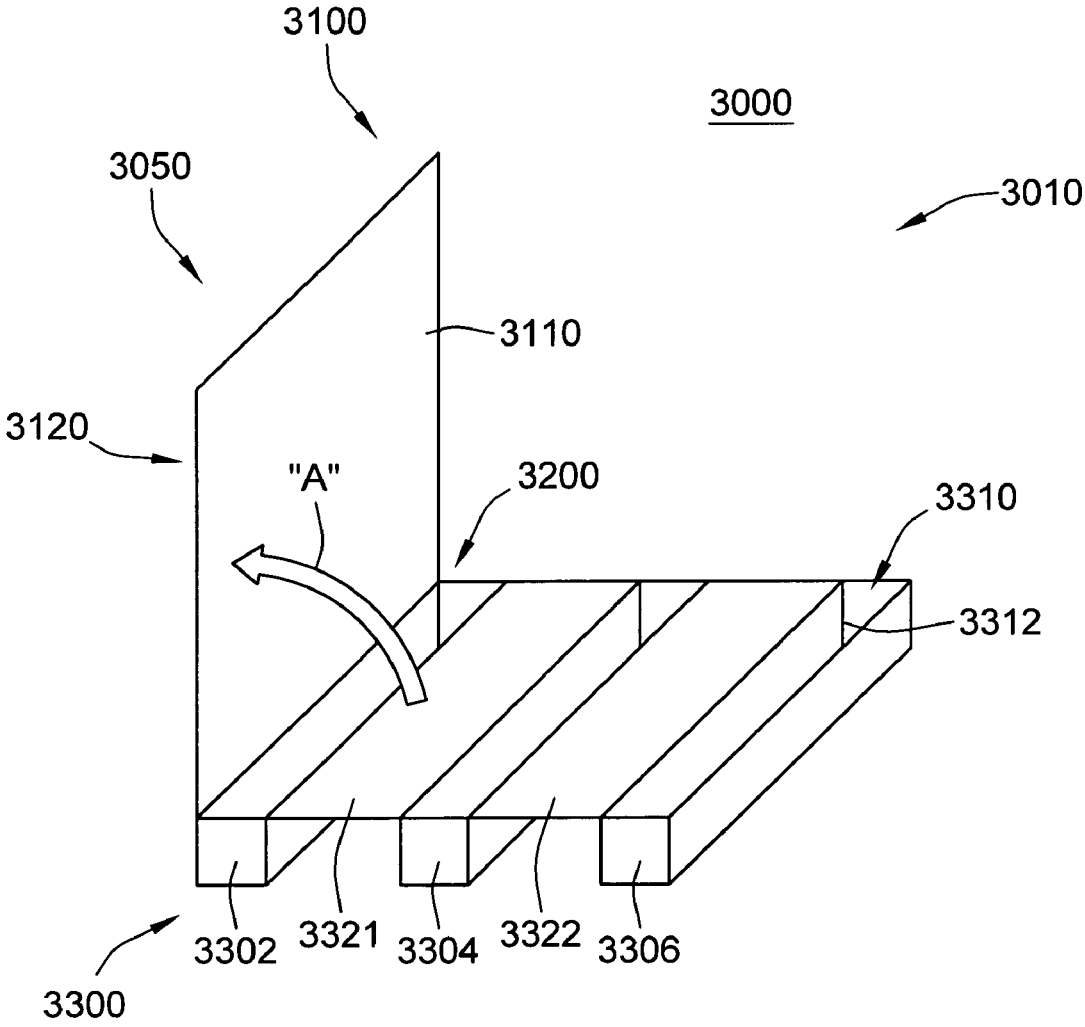
FIG. 1 shows a perspective view of one embodiment of a pallet according to the present invention.

The pallet 3000 as shown in FIG. 1 includes a platform 3100 and a hinge element 3200 connecting the platform 3100 to a support element 3300. For purposes of this application, a support element 3300 includes, for example, beams, planar sections, supporting inserts, cross-braces, and slats. As shown in FIG. 1, the support element 3300 includes a left, middle, and right beams 3302, 3304, 3306. Each of beams 3302, 3304, 3306 of this embodiment includes an interior surface 3310 that may define, for example, a generally rectangular interior space 3312 size and shaped to receive a correspondingly sized and shaped insert (not shown). Flat planar sections 3321, 3322 are situated between and provide a span between left and middle beams 3302, 3304 and middle and right beams 3304, 3306, respectively. It should be noted that the embodiment shown in FIG. 1 is lacking cross-braces, supporting inserts, and slats. The platform 3100 of the embodiment shown in FIG. 1, includes an inside surface 3110 and an outside surface 3120 defined by portions of the sheet 3010, which forms a product receiving surface 3050 when platform 3100 is in a horizontal position.

According to the present invention, a display element (see FIGS. 3-7) is accessible by moving the platform 3100 via hinge element 3200. As shown in FIG. 1, the platform 3100 is moved outwardly as shown by arrow "A". The display element may be a separate component that is stored and removeable from the inside surface 3110 of the platform 3100 of the pallet 3000 or configurable from the platform 3100 of the pallet 3000. A display element is displayable from at least the inside surface 3110 of the platform 3100. The display element may be erected once the pallet 3000 reaches its final display destination. The display element may be erected automatically or manually into position. The display element may be configurable to form a display of any size and/or configuration.

Figure 2:
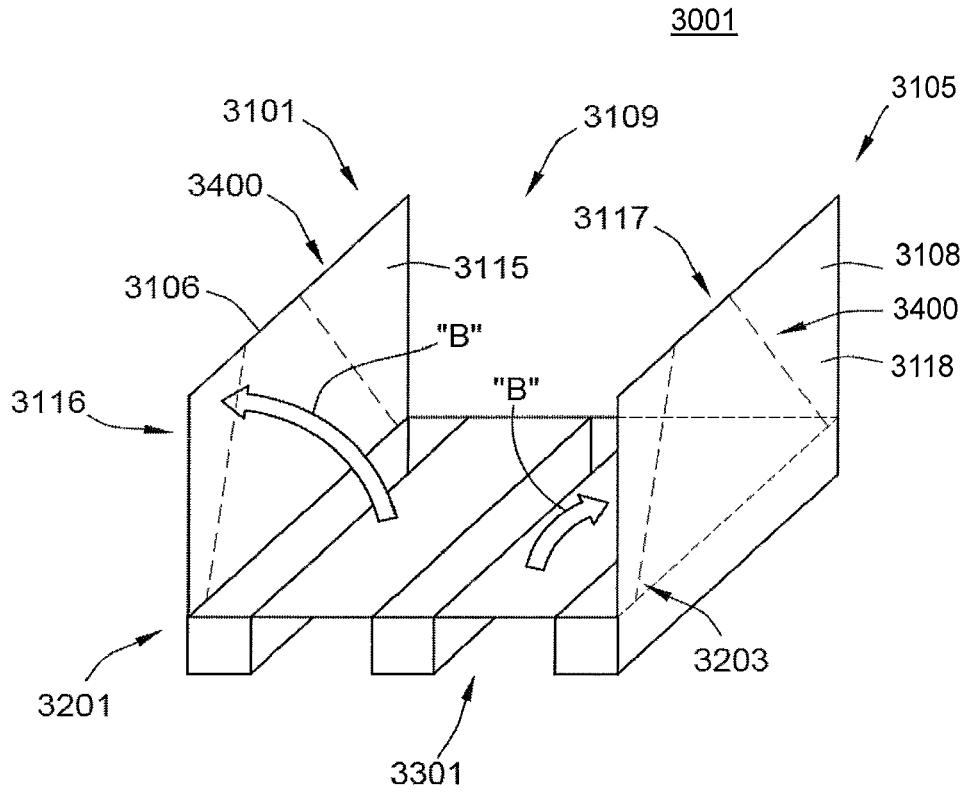
FIG. 2 shows a perspective view of another embodiment of a pallet according to the present invention.

The pallet 3001 as shown in FIG. 2 includes a platform 3101 that includes a first platform side 3106 and a second platform side 3108 defined by portions of the sheet 3105, which forms a product receiving surface 3109 when first platform side 3106 and second platform side 3108 are in a horizontal position. More specifically, the first platform side 3106 includes an inside surface 3115 and an outside surface 3116 and the second platform side 3108 includes an inside surface 3117 and an outside surface 3118.

A first hinge element 3201 connects the first platform side 3106 to a support element 3301. Again, a support element 3301 includes, for example, beams, planar sections, supporting inserts, cross-braces, and slats. A second hinge element 3203 connects the second platform side 3108 to the support element 3301.

In this embodiment, a display element (see FIGS. 3-7) is accessible by moving the platform 3101, more specifically moving the first platform side 3106 via first hinge element 3201 and the second platform side 3108 via second hinge element 3203 outwardly as shown by arrows "B".

The display element may be a separate component that is stored and removeable from the inside surfaces 3115, 3117 of the platform sides 3106, 3108 of the platform 3101 of the pallet 3001 or configurable from the platform 3101 of the pallet 3001. In embodiments where the display element is configurable from the platform 3101, the display element is erected by folding and/or unfolding portions using one or more score line elements 3400. The display element is displayable from at least the inside surfaces 3115, 3117 of the platform 3101. Again, the display element may be erected once the pallet 3001 reaches its final display destination. The display element may be erected automatically or manually into position. The display element may be configurable to form a display of any size and/or configuration.

Figure 3:
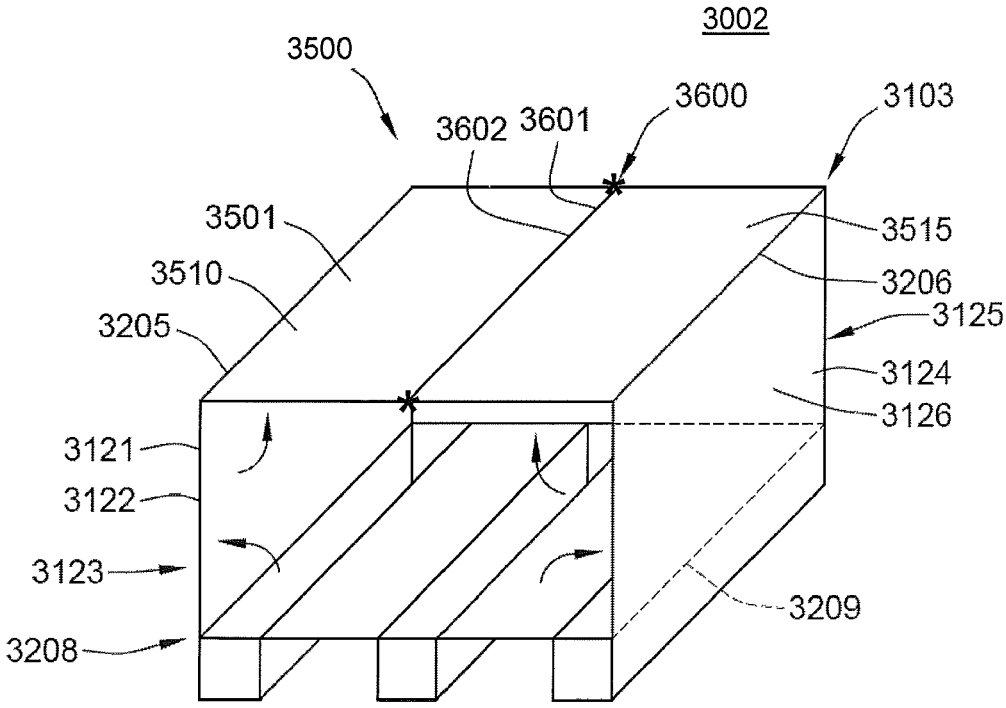
FIG. 3 shows an embodiment of a pallet and display element configurable to a shelf display according to the present invention.

FIG. 3 shows an embodiment of a pallet 3002 including display element 3500 configurable to a shelf display 3501 according to the present invention. The display element 3500 includes a first flap 3510 and a second flap 3515 that are displayable from the inside surface 3122 of the first platform side 3121 and the inside surface 3125 of the second platform side 3124, respectively. The first flap 3510 is connected to the first platform side 3121 via a first flexible joint 3205 and the second flap 3515 is connected to the second platform side 3124 via a second flexible joint 3206.

The display element 3500 is accessible by moving the platform 3103, more specifically moving the first platform side 3121 via first hinge element 3208 and the second platform side 3124 via second hinge element 3209 outwardly as shown by arrows "B". The first flexible joint 3205 and second flexible joint 3206 permit the first flap 3510 and the second flap 3515, respectively, to be configurable such as that shown by arrows "C" to erect a shelf display 3501.

It is also contemplated that the first flap 3510 and the second flap 3515 may be connected by one or more fastening component 3600 along ends 3601, 3602, but it should be noted that the fastening component 3600 may be anywhere on the platform sides 3121, 3124 and/or flaps 3510, 3515. The display element is erected to a shelf display and can be used as a point-of-purchase display.

Figure 4A:
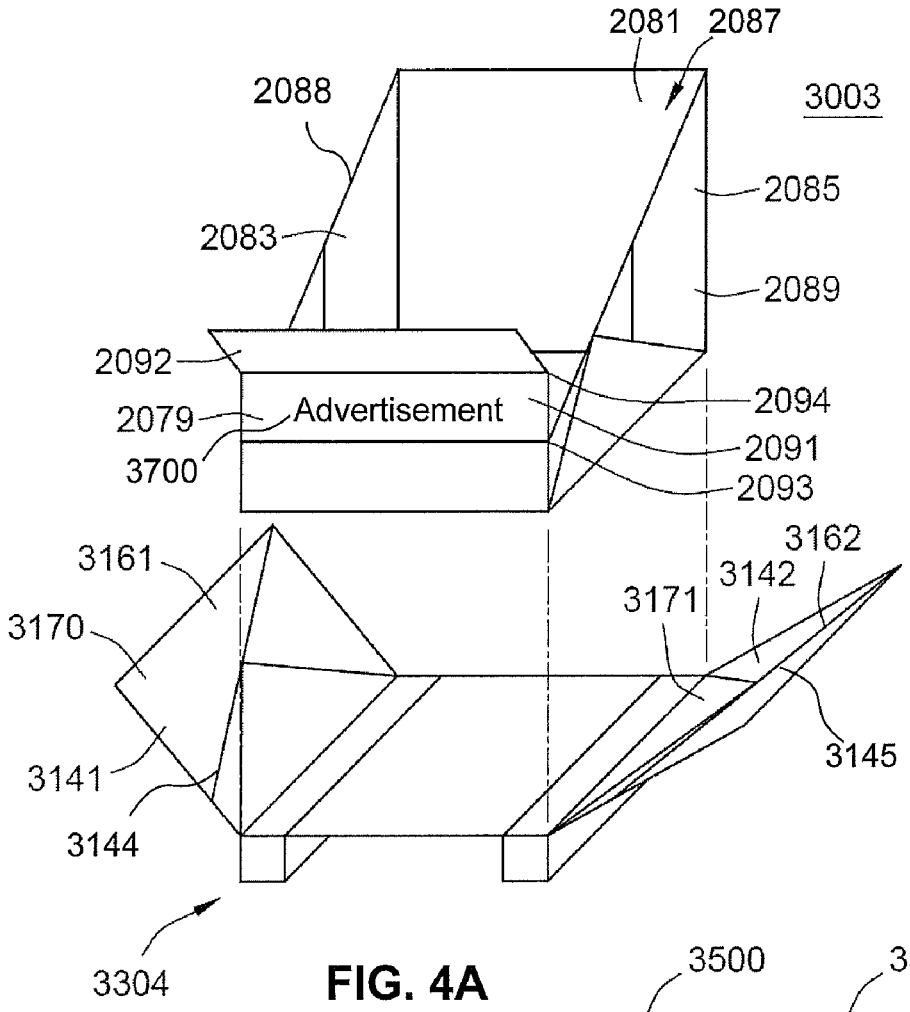
FIGS. 4A-4B show an embodiment of a pallet and display element configurable to a bin display according to the present invention.
Figure 4B:
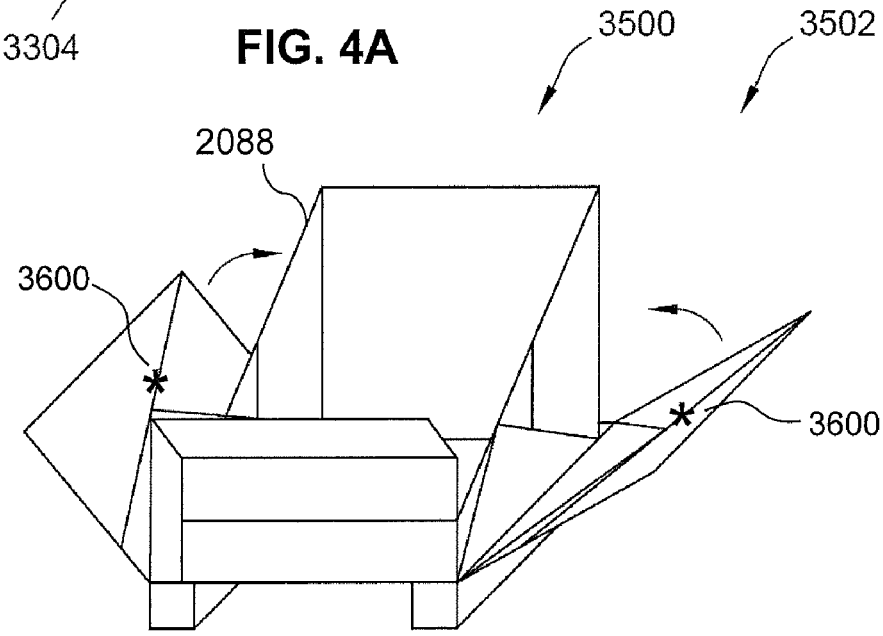
Figure 5A:
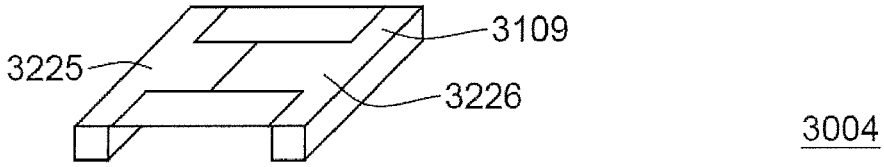
FIGS. 5A-5D show another embodiment of a pallet and display element configurable to a bin display according to the present invention.
Figure 5B:
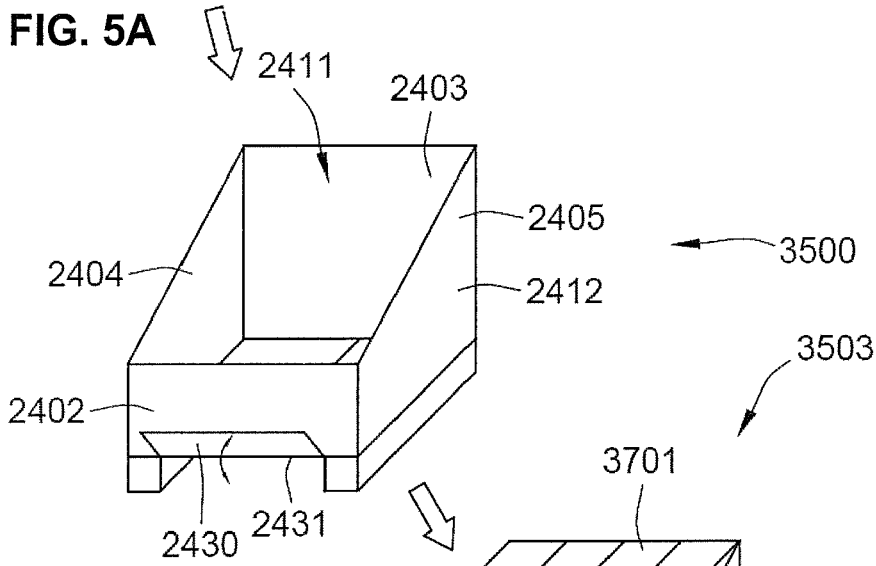
Figure 5C:
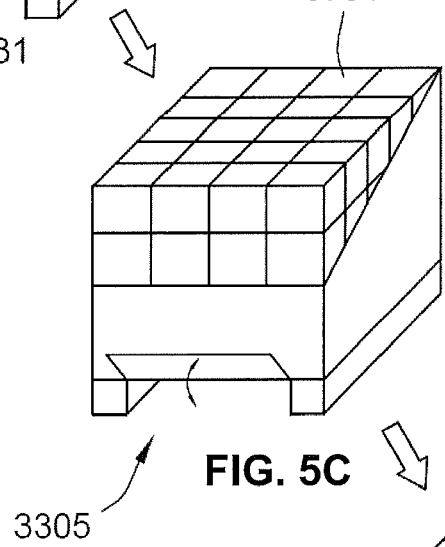
Figure 5D:
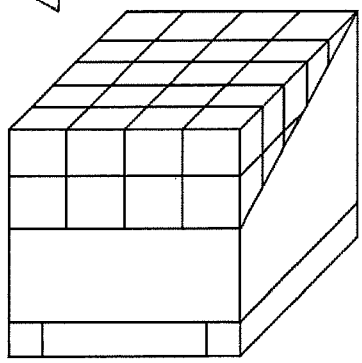

FIGS. 4A-4B show an embodiment of a pallet and display element 3500 configurable to a bin display 3502 wherein the display element 3500 is a separate component that is stored and removable from the pallet 3003. The display element 3500 is shipped and stored in a largely flattened state and erected once the pallet 3003 reaches its final display destination.

The display element includes a front sheet 2079, a rear sheet 2081, two side sheets 2083, 2085 each with an inner surface 2087 and an outer surface 2089. The sheets 2079, 2081, 2083, 2085 are erected such that the inner surfaces 2087 of each sheet 2079, 2081, 2083, 2085 create an interior space, or bin display 3502. The bin display 3502 encases goods (not shown) and can be used as a point-of-purchase display.

The outer surfaces 2089 of each sheet 2079, 2081, 2083, 2085 can have display information 3700, such as advertising. The front sheet 2079 has two extension sheets 2091, 2092 attached at fold line elements 2093, 2094. The extension sheets 2091, 2092 fold downwardly to conceal the support element 3304 for aesthetic appeal and also functions to prevent dirt and dust from collecting under the pallet 3003.

It is also contemplated that the extension sheets 2091, 2092 may be folded to reinforce the front sheet 2079.

The platform sides 3141, 3142 further include scoreline elements 3144, 3145 such that a first portion 3170 of the first platform side 3141 and a second portion 3171 of the second platform side 3142 fold over the side sheets 2083, 2085 of the bin display 3502. This adds reinforcement to the bin display 3502 as well as accommodates the platform sides 3141, 3142. It is also contemplated that fastening components 3600 may be used to secure the platform sides 3141, 3142 to the side sheets 2083, 2085 of the bin display 3502.

FIGS. 5A-5D show an embodiment of a pallet 3004 and display element 3500 configurable to a bin display 3503 wherein the display element 3500 is configurable from the platform 3109 of the pallet 3004. The display element 3500 is shipped and stored in a largely flattened state and erected once the pallet 3004 reaches its final display destination.

The display element 3500 is displayable from the inside surface of the platform 3109. The first platform side 3225 and second platform side 3226 are open outward to reveal a front sheet 2402, a rear sheet 2403 and two side sheets 2404, 2405 of a display element 3500.

The front sheet 2402, a rear sheet 2403, two side sheets 2404, 2405 each have an inner surface 2411 and an outer surface 2412. The sheets 2402, 2403, 2404, 2405 are erected such as by folding and/or unfolding such that the inner surfaces 2411 of each sheet 2402, 2403, 2404, 2405 create an interior space, or bin 3503. The bin 3503 encases goods 3701 and can be used as a point-of-purchase display.

The outer surfaces 2412 of each sheet 2402, 2403, 2404, 2405 can have display information 3700, such as advertising. The front sheet 2402 has an extension sheet 2430 attached at fold line elements 2431. The extension sheet 2430 folds downwardly to conceal the support element 3305 for aesthetic appeal and also functions to prevent dirt and dust from collecting under the pallet 3004. It is also contemplated that the extension sheet 2430 may be folded to reinforce the front sheet 2402.

Figure 6A:
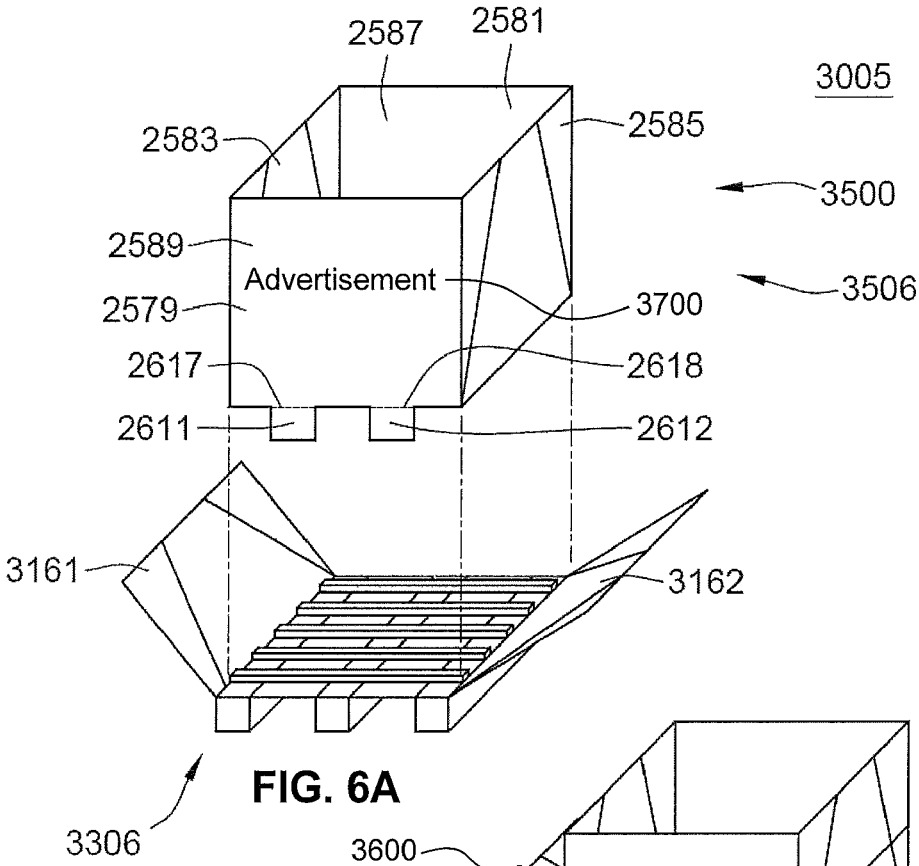
FIGS. 6A-6C show yet another embodiment of a pallet and display element configurable to a container display according to the present invention.
Figure 6B:
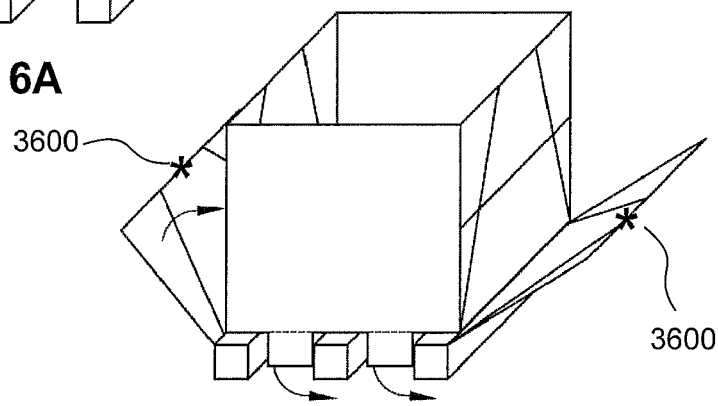
Figure 6C:
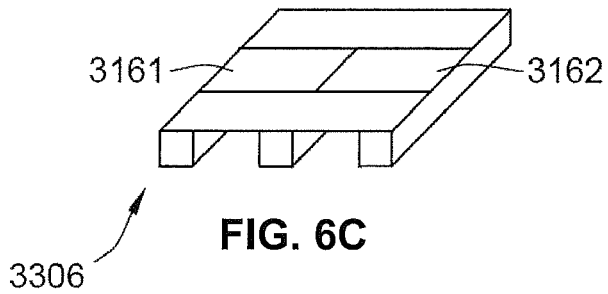

FIGS. 6A-6C show an embodiment of a pallet 3005 and display element 3500 configurable to a container display 3506 wherein the display element 3500 is a separate component that is stored and removable from the inside surface of the platform. The display element 3500 is shipped and stored in a largely flattened state and erected once the pallet 3005 reaches its final display destination.

The display element includes a front sheet 2579, a rear sheet 2581, two side sheets 2583, 2585 each with an inner surface 2587 and an outer surface 2589. The sheets 2579, 2581, 2583, 2585 are erected such that the inner surfaces 2587 of each sheet 2579, 2581, 2583, 2585 create an interior space, or container 3506. The container 3506 encases goods (not shown) and can be used as a point-of-purchase display.

The outer surfaces 2589 of each sheet 2579, 2581, 2583, 2585 can have display information 3700, such as advertising. The front sheet 2579 has a first extension sheet 2611 and a second extension sheet 2612 attached at fold line elements 2617, 2618, respectively. The extension sheets 2611, 2612 fold downwardly to conceal the support element 3306 for aesthetic appeal and also functions to prevent dirt and dust from collecting under the pallet 3005.

The platform sides 3161, 3162 fold to the side sheets 2583, 2585 of the container display 3506. This adds reinforcement to the container display 3506 as well as accommodates the platform sides 3161, 3162. It is also contemplated that fastening components 3600 may be used to secure the platform sides 3161, 3162 to the side sheets 2583, 2585 of the container display 3506.

Figure 7:
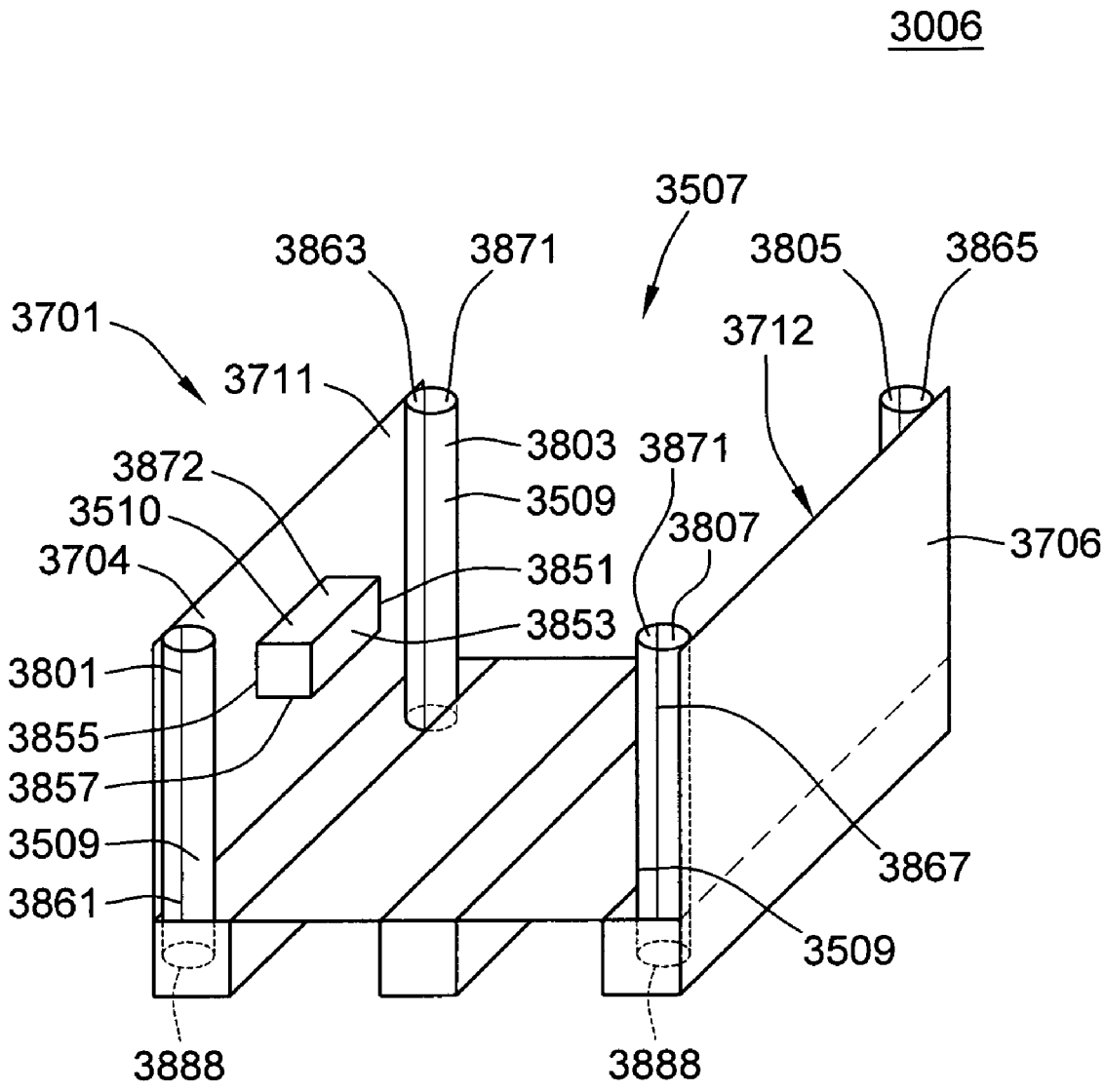
FIG. 7 shows yet another embodiment of a pallet and display element configurable to a tube and cell display according to the present invention.

FIG. 7 shows an embodiment of a pallet 3006 and display element 3500 configurable to a combination tube and cell display 3507 wherein the display element 3500 is configurable from the platform 3701 of the pallet 3006. The display element 3500 is shipped and stored in a largely flattened state and erected once the pallet 3006 reaches its final display destination.

The display element 3500 is displayable from the inside surfaces 3711, 3712 of the platform. The first platform side 3704 and second platform side 3706 are open outward to reveal a plurality of circular sheets 3801, 3803, 3805, 3807 and four planar sheets 3851, 3853, 3855, 3857 to erect a combination tube a cell display 3507.

The circular sheets 3801, 3803, 3805, 3807 are erected such as by folding and/or unfolding along fold line elements 3861, 3863, 3865, 3867 such that the inner surfaces 3871 of each sheet create an interior space, or tube 3509. The planar sheets 3851, 3853, 3855, 3857 are erected such as by folding and/or unfolding such that the inner surfaces 3872 of each sheet 3851, 3853, 3855, 3857 along with the inside surface 3711 of the platform side 3704 create an interior space, or cell 3510. The tubes 3509 and cell 3510 create the combination display 3507 and encase goods (not shown) and can be used as a point-of-purchase display.

It is further contemplated that the circular sheets 3801, 3803, 3805, 3807 include a supporting end 3888 such that the circular sheets 3801, 3803, 3805, 3807 are erected and function to provide support to the platform sides 3704, 3706 so that they do not collapse inward. The supporting end 3888 of the circular sheets 3801, 3803, 3805, 3807 may be supported by numerous contemplated methods, for example, the supporting end may be engaged with receiving components in the support element, the supporting end may be engaged in a tension fit with the pallet or engaged in a tension fit with the surface, or floor, on which the pallet is positioned.

Although the present invention has been described with respect to display elements that form displays in the form of a shelf, bin, container, and combination display in the form of a tube and cell. it is contemplated that the display element may be configurable to any combination of one or more displays of cases, shelves, containers, cells, bins, tubes and towers and further be erected to form a display of any size and/or configuration.

While the present inventions and what is considered presently to be the best modes thereof have been described in a manner that establishes possession thereof by the inventors and that enables those of ordinary skill in the art to make and use the inventions, it will be understood and appreciated that there are many equivalents to the exemplary embodiments disclosed herein and that myriad modifications and variations may be made thereto without departing from the scope and spirit of the inventions, which are to be limited not by the exemplary embodiments but by the appended claims.

I claim:

1. A pallet, comprising:

a support element, wherein the support element includes two or more beams;

a platform including a first platform side and a second platform side, the first platform side being opposite the second platform side;

a first hinge element connecting the first platform side to the support element;

a second hinge element connecting the second platform side to the support element; and a display element, wherein the display element is a separate component that is removable from the platform upon opening outward relative to the center of the pallet the first platform side from the first hinge and the second platform side from the second hinge, the display element includes a front sheet, a rear sheet, a first side sheet, a second side sheet, and one or more score line elements for folding and unfolding to erect the display element to create a bin display positionable on the platform, wherein the front sheet of the display element further comprises one or more extension sheets and the one or more extension sheets includes at least one fold line element such that the one or more extension sheets fold downwardly to conceal the support element.

2. The pallet according to claim 1, wherein the display element further comprises display information.

3. The pallet according to claim 1, wherein the first platform side includes a first score line element and the second platform side includes a second score line element.

4. The pallet according to claim 3, wherein a portion of the first platform side folds at the first score line element over the first side sheet of the display element and a portion of the second platform side folds at the second score line element over the second side sheet of the display element.

5. The pallet according to claim 4 further comprising one or more fastening components, wherein the one or more fastening components secure the first platform side to the first side sheet and the second platform side to the second side sheet.

* * * * *